US011555488B2

(12) United States Patent
Andersen et al.

(10) Patent No.: US 11,555,488 B2
(45) Date of Patent: Jan. 17, 2023

(54) VALVE PLATE ASSEMBLY

(71) Applicant: Danfoss A/S, Nordborg (DK)

(72) Inventors: Stig Kildegaard Andersen, Krusaa (DK); Frank Holm Iversen, Padborg (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 17/039,210

(22) Filed: Sep. 30, 2020

(65) Prior Publication Data

US 2021/0190066 A1 Jun. 24, 2021

(30) Foreign Application Priority Data

Dec. 19, 2019 (DE) ..... 102019135086.7

(51) Int. Cl.

| | |
|---|---|
| ***F04B 1/2042*** | (2020.01) |
| ***F04B 53/10*** | (2006.01) |
| ***F04B 1/20*** | (2020.01) |
| ***F01B 3/00*** | (2006.01) |

(52) U.S. Cl.

CPC ..... *F04B 1/2042* (2013.01); *F01B 3/0055* (2013.01); *F04B 1/20* (2013.01); *F04B 53/10* (2013.01)

(58) Field of Classification Search

CPC ..... F04B 1/122; F04B 1/141; F04B 1/2042; F04B 1/205; F04B 1/2021; F04B 1/2035; F04B 1/2007; F04B 27/0817; F04B 27/0826; F04B 27/0839; F04B 27/0843; F04B 53/10; F04B 53/102; F04B 53/103; F04B 53/108; F16K 11/02; F16K 11/074; F16K 11/0743; F16K 11/076; F03C 1/0636; F03C 1/0647; F03C 1/0655;

(Continued)

(56) References Cited

U.S. PATENT DOCUMENTS

| | | | | |
|---|---|---|---|---|
| 3,037,489 | A * | 6/1962 | Douglas | F03C 1/0655 91/485 |
| 3,249,061 | A * | 5/1966 | Ricketts | F01B 3/0055 91/486 |
| 3,295,460 | A | 1/1967 | Thompson | |

(Continued)

FOREIGN PATENT DOCUMENTS

| | | |
|---|---|---|
| DE | 1 006 262 B | 4/1957 |
| DE | 2 049 003 A | 4/1972 |

(Continued)

OTHER PUBLICATIONS

Search Report for Great Britain Patent Application No. GB2019705.9 dated May 28, 2021.

(Continued)

*Primary Examiner* — Charles G Freay
*Assistant Examiner* — Chirag Jariwala
(74) *Attorney, Agent, or Firm* — McCormick, Paulding & Huber PLLC

(57) ABSTRACT

A valve plate assembly (1) of a hydraulic axial piston machine is described, the valve plate assembly comprising a wear plate (2) made of a ceramic material surrounded by a compression ring (4). Such a valve plate assembly should be produced and maintained in a cost-effective manner. To this end, the wear plate (2) is connected to a support plate (3) by means of the compression ring (4).

20 Claims, 2 Drawing Sheets

(58) Field of Classification Search
CPC .... F01B 3/0055; F01B 3/0082; F01B 3/0032; F01B 3/0044; F01B 3/0047
USPC ..... 92/71
See application file for complete search history.

(56) References Cited

U.S. PATENT DOCUMENTS

| | | | | | |
|---|---|---|---|---|---|
| 3,362,342 | A * | 1/1968 | Flint | F01B 3/104 | 417/502 |
| 3,523,678 | A * | 8/1970 | Wright | F04B 1/2042 | 251/316 |
| 3,756,279 | A * | 9/1973 | Widmaier | F04B 1/2042 | 137/625.21 |
| 3,818,803 | A * | 6/1974 | Scott | F04B 15/02 | 91/499 |
| 4,481,867 | A | 11/1984 | Nagase et al. | | |
| 5,022,310 | A * | 6/1991 | Stewart | F01B 3/005 | 417/269 |
| 5,279,205 | A * | 1/1994 | Carlson, Jr. | F01B 3/0032 | 91/485 |
| 5,316,451 | A * | 5/1994 | Hore | F04B 15/02 | 417/457 |
| 5,540,139 | A * | 7/1996 | Martensen | F04B 1/2021 | 417/269 |
| 5,752,428 | A | 5/1998 | Jepsen | | |
| 10,094,364 | B2 | 10/2018 | MacHarg | | |
| 2004/0216601 | A1* | 11/2004 | Matsumoto et al. | F04B 27/0839 | 91/499 |
| 2005/0089410 | A1 | 4/2005 | Matsumoto et al. | | |
| 2007/0022873 | A1* | 2/2007 | Sund | F04B 1/2021 | 92/71 |
| 2012/0192954 | A1* | 8/2012 | Jorgenson | F16K 3/10 | 251/210 |
| 2015/0204448 | A1 | 7/2015 | McEvoy et al. | | |
| 2016/0273525 | A1 | 9/2016 | Criville | | |
| 2016/0281505 | A1* | 9/2016 | MacHarg | F04B 1/2028 | |
| 2021/0189878 | A1 | 6/2021 | Andersen et al. | | |

FOREIGN PATENT DOCUMENTS

| | | | | |
|---|---|---|---|---|
| DE | 1653540 | B1 * | 1/1976 | F01B 3/0055 |
| DE | 42 94 699 | T1 | 1/1994 | |
| DE | 43 41 850 | A1 | 6/1995 | |
| DE | 195 25 852 | B4 | 1/1997 | |
| DE | 10 2008 060 067 | A1 | 6/2010 | |
| DE | 102 23 844 | B4 | 4/2013 | |
| DE | 10 2013 205 263 | A1 | 10/2014 | |
| DE | 102014225497 | A1 | 6/2015 | |
| EP | 0 708 242 | A1 | 4/1996 | |
| EP | 1 705 372 | A1 | 9/2006 | |
| EP | 1 748 187 | A2 | 1/2007 | |
| FR | 1 233 394 | A | 10/1960 | |
| FR | 1482992 | A * | 6/1967 | F01B 3/0055 |
| FR | 2002009 | A1 * | 10/1969 | F01B 3/0055 |
| JP | 2004270524 | A * | 9/2004 | F04B 39/00 |
| JP | 2007327433 | A | 12/2007 | |
| JP | 58128477 | B2 | 11/2015 | |
| WO | 93/14298 | A1 | 7/1993 | |

OTHER PUBLICATIONS

Search Report for Great Britain Patent Application No. GB2019704.2 dated May 25, 2021.
Breuer, "DE102013205263A_MT.pdf" (Machine Translation) (Year:2014).

* cited by examiner

VALVE PLATE ASSEMBLY

CROSS-REFERENCE TO RELATED APPLICATION

This application claims foreign priority benefits under 35 U.S.C. § 119 to German Patent Application No. 102019135086.7 filed on Dec. 19, 2019, the content of which is hereby incorporated by reference in its entirety.

TECHNICAL FIELD

The present invention relates to a valve plate assembly of an axial piston machine comprising a wear plate made of a ceramic material surrounded by a compression ring.

BACKGROUND

Such a valve plate assembly is known, for example, from U.S. Pat. No. 10,094,364 B2.

In a hydraulic axial piston machine a cylinder block rotates in a housing. The cylinder block is provided with a number of cylinders. In each cylinder a piston is moveable up and down. One end of the piston bears a slide shoe which slides over a swash plate and is held in contact with the swash plate by means of retainer means. A valve system is arranged at the other end of the cylinder drum. The valve system comprises a valve plate assembly rotating with the cylinder block and a stationary part which is fixed to the housing.

When oil is used as hydraulic fluid, there is usually no problem with friction between moving parts. However, when liquids are used which do not have a lubricating effect, like water, the problem of friction has to be solved by other means.

One possibility is to use special plastic materials, like PEEK (Polyetheretherketone). However, a plastic material is not very resistant to wear caused by particles in the pumped fluid.

To overcome this problem, it is attractive to form the tribological surface from a ceramic material with high wear resistance and a low coefficient of friction under fluid lubricated conditions.

It is, however, difficult to bring the ceramic material in the desired form.

SUMMARY

The object underlying the invention is to produce and maintain a valve plate assembly of a hydraulic axial piston machine in a cost-effective manner.

This object is solved in that the wear plate is connected to a support plate by means of the compression ring.

In such an arrangement the wear plate can be made very flat to ensure a good seal, low friction, and low wear in the sliding contact between the valve plate assembly and the stationary part of the valve system. The wear plate is relatively resistant to wear caused by particles in the pumped fluid. Furthermore, the wear plate is resilient against thermal shocks that can occur, for instance, when a cold machine is started and is suddenly filled with hot water or another liquid from pipes that have been heated by hot weather and direct sunlight. The valve plate assembly can also absorb an axially directed force from the cylinder block towards the stationary part of the valve system, e.g. originating from the springs that push the retainer means towards the swash plate. Furthermore, the valve plate assembly is a wear part. If wear occurs, the repair should be as cheap as possible. Thus, it is of advantage that it is not necessary to replace the entire rotating part of the valve system, but only the wear plate.

In an embodiment of the invention the compression ring comprises a fixation geometry accommodating fixing means connecting the compression ring to the support plate. The fixation geometry can be, for example, a hole having an inner thread so that the compression ring can be fixed to the support plate by means of screws or bolts. The compression ring not only protects the ceramic wear plate against rapid pressure changes and high internal pressure that could cause high tensile stresses and destroy an unprotected ceramic wear plate, but is also used for the connection of the ceramic wear plate to the support plate.

In an embodiment of the invention thrust pads are fixed in the support plate on a side opposite to the wear plate, wherein the thrust pads end in the support plate. The thrust pads form a connection between the cylinders in the cylinder block and the support plate, so that liquid from or to the cylinders can flow without leaking between the support plate and the cylinder block.

In an embodiment of the invention the thrust pads abut against a stop surface in the support plate. In other words, the thrust pads can be inserted into a stepped bore. This gives a defined position of the thrust pads in the support plate. Hydraulic pressures acting on the thrust pads can be transferred to the support plate.

In an embodiment of the invention the support plate comprises a number of first openings and the wear plate comprises a number of second openings, wherein the form of the first openings differs from the form of the second openings. The first openings and the second openings are through going openings and form a fluid passage through the respective plates. When the form of the first openings differs from the form of the second openings, it is possible to chose a simple form for the second openings in the ceramic wear plate which makes the production of the wear plate simple and cost-effective.

In an embodiment of the invention the first openings have a cross section which changes in an axial direction of the support plate and the second openings have a constant cross section. The constant cross section facilitates the production of the wear plate. The varying cross section of the first opening allows a transition from the cylindrical thrust pads to another cross section which is adapted to the cross section of the second openings.

In an embodiment of the invention sealing means are arranged between the support plate and the wear plate. The sealing means can be in form of O-rings. The sealing mean avoid a leakage between the wear plate and the support plate.

In an embodiment of the invention each of the sealing means is arranged in a groove surrounding the first opening, wherein an area limited by the sealing means is of non-circular form. The non-circular form can be, for example, a section of a circular ring. This is of advantage when the second openings in the wear plate are also in form of sections of a circular ring. Furthermore, when the area extends in circumferential direction over the respective first openings, a uniform distribution of the contact pressure between the valve plate assembly, i.e. the rotating part of the valve system, and the stationary part of the valve system can be achieved.

In an embodiment of the invention the area limited by the sealing means is smaller than an area defined by a thrust pad on the opposite side of the support plate. Thus, hydraulic forces from the areas between the wear plate and the thrust pads are slightly smaller than the hydraulic forces from the thrust pads. This means that the net effect of the hydraulic forces is to keep the support plate slightly pressed against the wear plate, i.e. the pressure does not generate a separating force between the support plate and the wear plate. Because of this design the support plate and the wear plate can easily be held together with weak connecting means, like three small screws that engage in the threaded holes in the compression ring. These screws also serve to correctly position the wear plate relative to the support plate.

In an embodiment of the invention the support plate comprises an elastically deformable spring section. The spring section is in one part with the support plate. The spring section acts between the support plate and the cylinder block. The spring section ensures that the contact force between the cylinder block and the support plate is transferred to the support plate in a well distributed way which can be made nearly symmetric about the axis of rotation of the cylinder block, even if the cylinder block has a slight misalignment relative to the stationary part of the valve system.

In an embodiment of the invention the spring section is machined out of the support plate. The spring section can be produced, for example, by turning.

BRIEF DESCRIPTION OF THE DRAWINGS

A preferred embodiment of the invention will now be described in more detail with reference to the drawing, in which.

DETAILED DESCRIPTION

Figure 1:
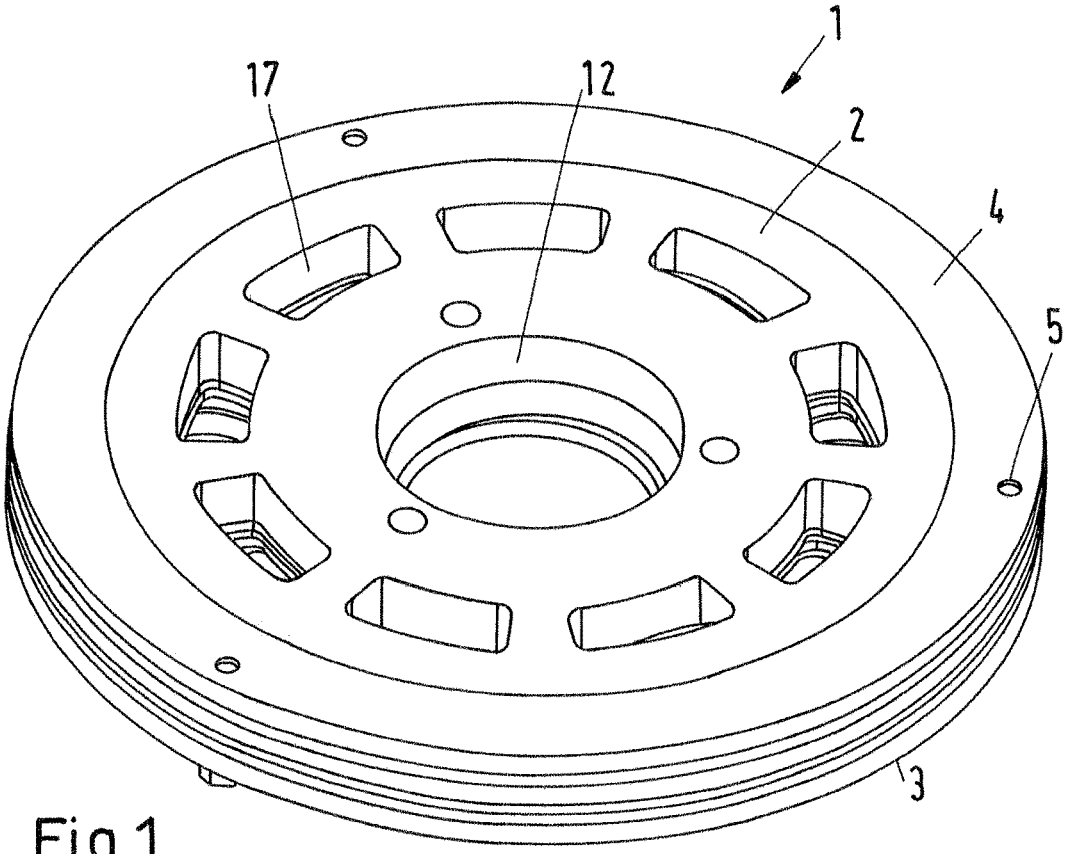
FIG. 1 shows a valve plate assembly.

FIG. 1 shows a valve plate assembly 1 of a hydraulic axial piston machine. The valve plate assembly 1 comprises a wear plate 2 made of a ceramic material and a support plate 3 made of another material. The support plate 3 can be made, for example, from a metallic material like steel or stainless steel.

The wear plate 2 is surrounded by a compression ring 4. The compression ring 4 preloads in compression the wear plate 2. The compression ring 4 is fitted onto the wear plate 2. The heavy preload ensures that no significant tensile stresses occur in the wear plate 2 due to pressure loads or thermal shocks.

The compression ring 4 comprises a number of fixation geometries 5. The fixation geometries 5 can be in form of screw holes, i.e. holes having an inner thread. The compression ring 4 can be connected to the support plate 3 by means of screws 6. In the embodiment shown in FIG. 1 the fixation geometry 5 is a through going hole. However, this is not necessary. It can be as well a blind hole.

The support plate 3 has likewise some holes 7 through which the screws 6 can be pushed. The screws 6 can be rather weak. They are necessary only to fix the combination of wear plate 2 and compression ring 4 to the support plate 3 and to correctly position the wear plate 2 relative to the support plate 3. It is not required that they withstand greater forces as will be explained below.

Figure 3:
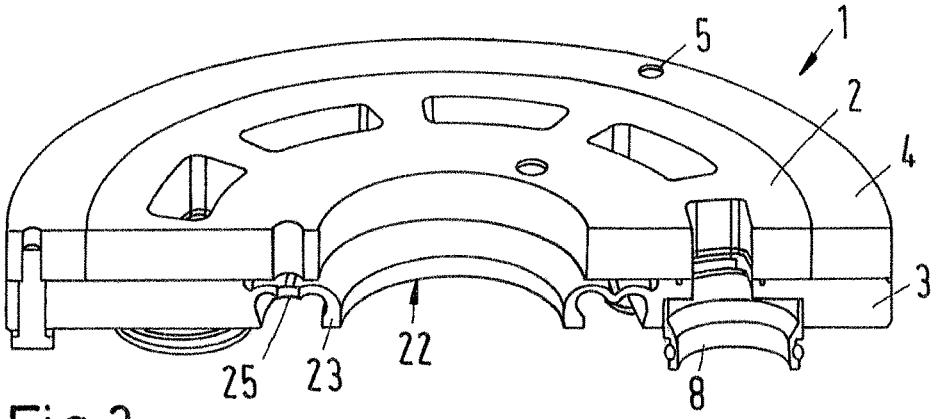
FIG. 3 shows a sectional view of the valve plate assembly.

FIG. 3 shows the valve plate assembly 1 in cross sectional view.

Thrust pads 8 are fixed in the support plate 3 on a side opposite the wear plate 2. The thrust pads 8 are pressed into the support plate with interference fit. The thrust pads 8 plastically deform when pressed in and, thereby, absorb production tolerances in the thrust pads 8 and the support plate 3.

Figure 5:
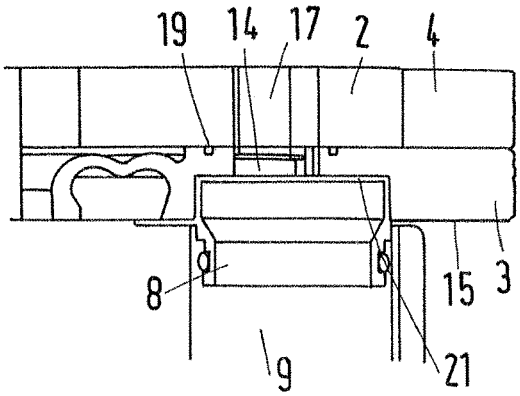
FIG. 5 shows an enlarged view of a part of the valve plate assembly.
Figure 4:
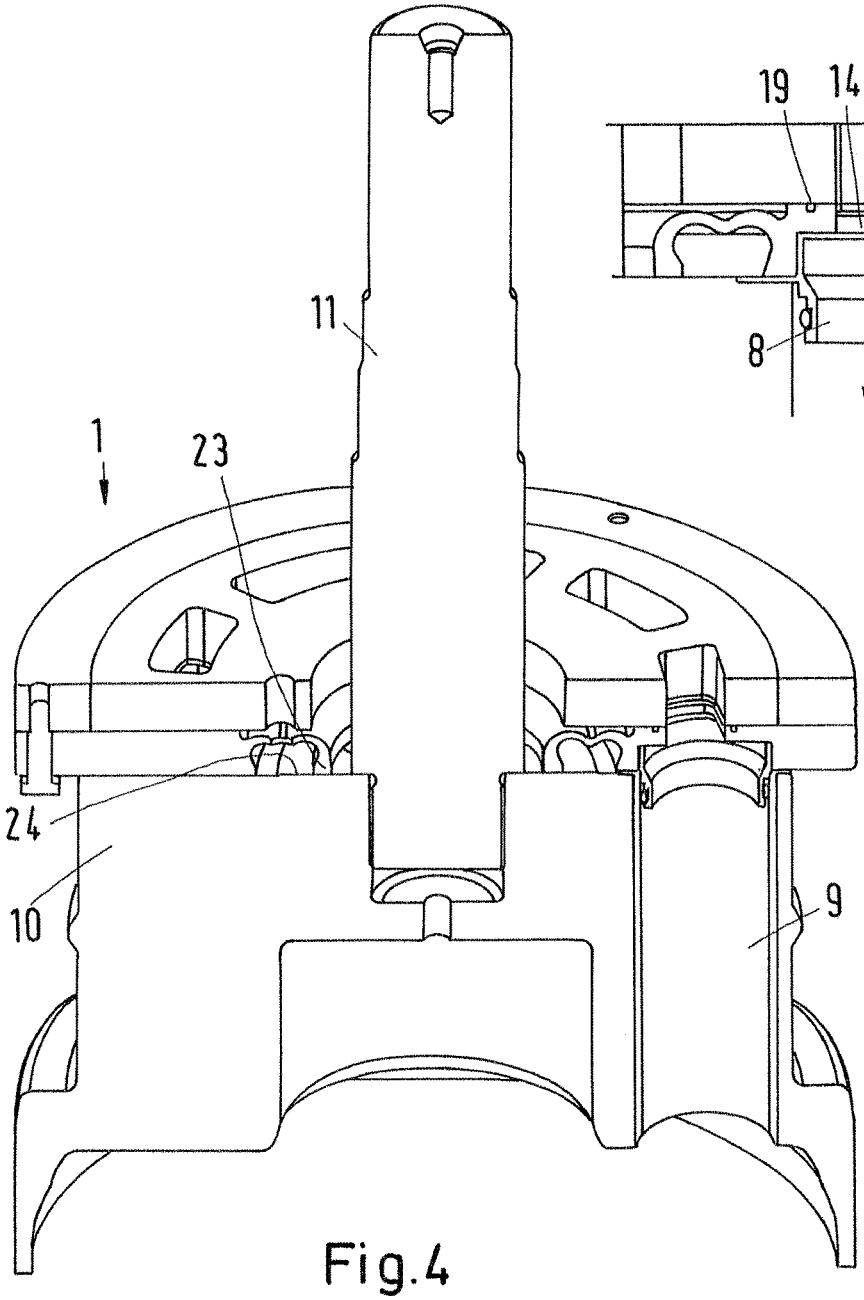
FIG. 4 shows the valve plate assembly in connection with a cylinder block.

As can be seen in FIGS. 4 and 5 the thrust pads 8 are inserted into a cylinder 9 which is provided in a cylinder block 10. The valve plate assembly 1 is fixed to the cylinder block 10 through the insertion of the thrust pads in the cylinders and rotates together with the cylinder block 10. A stationary part of a valve system and a housing in which the cylinder block 10 is arranged is not shown. The cylinder block 10 is connected to a shaft 11.

The wear plate 2 comprises a central opening 12 and the support plate 3 comprises a central opening 13 so that the shaft 11 can be guided through the valve plate assembly 1.

Figure 2:
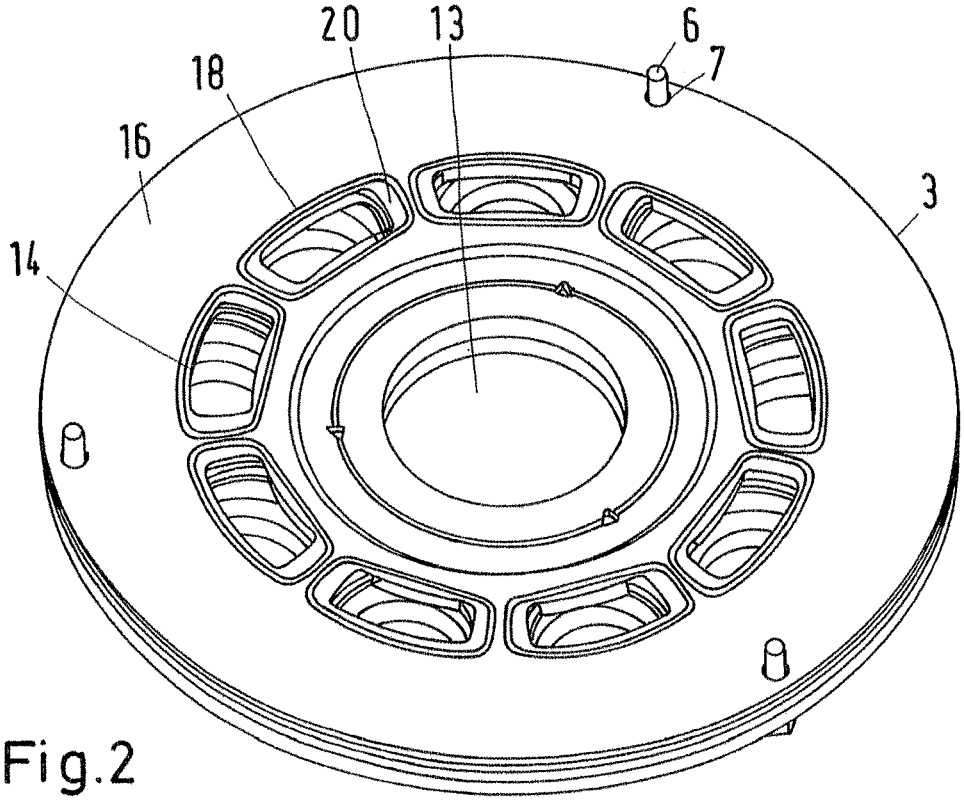
FIG. 2 shows a support plate.

The thrust pads 8 are of circular form. Thus, the support plate 3 comprises first openings 14 which are of circular form on a side 15 of the support plate 3 facing away from the wear plate 2. However, as can be seen in FIG. 2, the first openings 14 have another form on a side 16 of the support plate 3 facing the wear plate 2. The form of the first openings 14 in the side 16 corresponds to a section of an annular ring. Thus, the cross section of the first openings 14 varies in axial direction, i.e. in a direction parallel to the axis of rotation of the cylinder bock 10.

The wear plate 2 comprises a corresponding number of second openings 17. The form of the second openings 17 corresponds to the form of the openings 14 in the side 16 and corresponds to a section of an annular ring. The cross section of the second openings 17 is constant in axial direction, so that it is rather simple to produce the wear plate 2.

As can be seen in FIG. 2, the support plate 3 comprises a groove 18 around each first opening 14. Sealing means 19, for example in form of an O-ring, are arranged in the groove 18. The sealing means 19 secure a tightness between the wear plate 2 and the support plate 3.

The sealing means 19 limit a first area 20 on the side 16 of the support plate 3. This first area is slightly smaller than a second area defined by the thrust pads 8. This second area corresponds to the diameter of the cylinder 9. Thus, the thrust pads 8 generate hydraulic forces that push against the support plate 3. To this end, the support plate 3 comprises a stop 21 in each first opening 14 and the thrust pads 8 rest against the stop 21. The size of the first area 20 and of the sectional area of the cylinder 9 are designed so that the hydraulic pressure nearly balances out the forces from the thrust pads 8 onto the support plate 3. Thus, there are no separating forces between the wear plate 2 and the support plate 3. To the contrary, the support plate 3 is slightly pressed in a direction to the wear plate 2.

Furthermore, the size and form of the first areas 20 is designed to achieve a uniform distribution of the contact pressure between the valve plate assembly 1 and the not illustrated stationary part of the valve system.

The support plate 3 comprises a spring section 22. The spring section 22 is machined out of the support plate 3, for example by turning. The spring section 22 comprises a rim 23 resting against a protrusion 24 on the cylinder block 10. The rim 23 is connected to a radially outer part of the support plate 3 by means of a hinge section 25. The spring section 22 is integrated into the center of the support plate 3 and surrounds the shaft 11. The spring section 22 ensures that the contact force between the cylinder block 10 and the support plate 3 is transferred to the support plate 3 in a well distributed way which is nearly symmetric about the axis of rotation of the cylinder block 10, even if the cylinder block 10 has a slight misalignment relative to the stationary part of the valve system.

The component that accommodates most of the functions of the rotating part of the valve system, i.e. of the valve plate assembly 1, is made from the support plate 3 which is made from a metallic material that is much easier to machine to complex geometries than a ceramic material and which is also able to withstand tensile stresses much better than the ceramic material of the wear plate 2. The wear plate 2 can have a rather simple form and can be produced in cost-effective manner.

The wear plate 2 is a wear part which can easily be replaced simply by untightening the screws 6 removing the wear plate 2 together with the compressing ring 4 and mounting a new set of wear plate 2 and compression ring 4.

Thus, maintenance is cost-effective as well.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A valve plate assembly of a hydraulic axial piston machine, the valve plate assembly comprising a wear plate made of a ceramic material surrounded by a compression ring, wherein the wear plate is fixed to a support plate only by means of the compression ring, and wherein the valve plate assembly is configured to rotate with a cylinder block of the hydraulic axial piston machine.

2. The valve plate assembly according to claim 1, wherein the compression ring is fixed to the support plate by screws or bolts.

3. The valve plate assembly according to claim 1, wherein the support plate comprises an elastically deformable spring section.

4. The valve plate assembly according to claim 3, wherein the elastically deformable spring section is machined out of the support plate.

5. The valve plate assembly according to claim 1, wherein the compression ring comprises a fixation geometry accommodating fixing means connecting the compression ring to the support plate.

6. The valve plate assembly according to claim 5, wherein thrust pads are fixed in the support plate on a side opposite to the wear plate, wherein the thrust pads end in the support plate.

7. The valve plate assembly according to claim 5, wherein the support plate comprises a number of first openings and the wear plate comprises a number of second openings, wherein a form of each first opening of the number of first openings differs from a form of each second opening of the number of second openings.

8. The valve plate assembly according to claim 5, wherein the support plate comprises an elastically deformable spring section.

9. The valve plate assembly according to claim 5, wherein the fixation geometry is a threaded hole and wherein the fixation means is a screw or a bolt.

10. The valve plate assembly according to claim 1, wherein thrust pads are fixed in the support plate on a side opposite to the wear plate, wherein the thrust pads end in the support plate.

11. The valve plate assembly according to claim 10, wherein the support plate comprises a number of first openings and the wear plate comprises a number of second openings, wherein a form of each first opening of the number of first openings differs from a form of each second opening of the number of second openings.

12. The valve plate assembly according to claim 10, wherein the support plate comprises an elastically deformable spring section.

13. The valve plate assembly according to claim 10, wherein the thrust pads abut against a stop surface in the support plate.

14. The valve plate assembly according to claim 13, wherein the support plate comprises a number of first openings and the wear plate comprises a number of second openings, wherein a form of each first opening of the number of first openings differs from a form of each second opening of the number of second openings.

15. The valve plate assembly according to claim 1, wherein the support plate comprises a number of first openings and the wear plate comprises a number of second openings, wherein a form of each first opening of the number of first openings differs from a form of each second opening of the number of second openings.

16. The valve plate assembly according to claim 15, wherein each first opening of the number of first openings has a cross section which changes in an axial direction of the support plate and each second opening of the number of second openings has a constant cross section.

17. The valve plate assembly according to claim 16, wherein sealing means are arranged between the support plate and the wear plate.

18. The valve plate assembly according to claim 15, wherein sealing means are arranged between the support plate and the wear plate.

19. The valve plate assembly according to claim 18, wherein each of the sealing means is arranged in a groove surrounding a first opening of the number of first openings, wherein an area limited by each of the sealing means is of non-circular form.

20. The valve plate assembly according to claim 19, wherein the area limited by each of the sealing means is smaller than an area defined by a thrust pad on an opposite side of the support plate.

* * * * *